United States Patent [19]

Kinkel

[11] 4,185,137

[45] Jan. 22, 1980

[54] CONDUCTIVE SHEATH/CORE HETEROFILAMENT

[75] Inventor: Richard L. Kinkel, Charlotte, N.C.

[73] Assignee: Fiber Industries, Inc., Charlotte, N.C.

[21] Appl. No.: 842,764

[22] Filed: Oct. 17, 1977

Related U.S. Application Data

[63] Continuation of Ser. No. 648,436, Jan. 12, 1976, abandoned.

[51] Int. Cl.[2] ..... D02G 3/00

[52] U.S. Cl. ..... 428/372; 428/373; 428/97

[58] Field of Search ..... 428/373, 372, 374, 95, 428/97

[56] References Cited

U.S. PATENT DOCUMENTS 3,582,445 6/1971 Okuhashi ..... 428/97

FOREIGN PATENT DOCUMENTS 1393234 5/1975 United Kingdom ..... 428/373

*Primary Examiner*—Marion E. McCamish

*Attorney, Agent, or Firm*—Robert J. Blanke

[57] ABSTRACT

Conductive thermoplastic sheath/core filaments having a reflectivity greater than 8 percent in the undelustered filament and fiber blends containing at least some of said conductive filaments. The sheath/core filament employs as a core a thermoplastic polymer having dispersed therein a material selected from the group consisting of zinc oxide, cuprous iodide, colloidal silver and colloidal graphite. The conductive filament when blended with nonconductive filaments is found to have utility as face yarns in pile fabrics.

2 Claims, No Drawings

CONDUCTIVE SHEATH/CORE HETEROFILAMENT

This is a continuation, of application Ser. No. 648,436, filed Jan. 12, 1976, now abandoned.

This invention relates to conductive filaments and more specifically to conductive thermoplastic continuous filaments having a color suitable for use in textile applications.

Small percentages of conductive fibers in a blend with organic fibers have the propensity of dissipating electrostatic charges. In general, these fibers must have a resistance of less than $10^9$ ohms/inch at a potential of 2 kilovolts direct current. The electrostatic dissipating capability of the fibers is achieved even when these fibers fail to provide a continuous electrical path, either as the result of insufficiency in amount or as the result of being highly dispersed in the blend. It is theorized that the conductive fibers dissipate the static fields by charge delocalization through a smearing of the fields.

Conductive thermoplastic continuous filaments are known to the art, such filaments usually employing conductive surface coatings bonded to a filament substrate. While the carbon black and elemental metals employed in such surface coatings produce a high degree of conductivity in thermoplastic filaments, the intense coloration of these materials detracts from their use in textile applications. Representative of surface coated conductive thermoplastic filaments employing carbon black or elemental metals as the conductive element is U.S. Pat. No. 3,582,445.

An alternative to surface coatings has been set forth in British Pat. No. 1,393,234, wherein a sheath/core filament is set forth, the core of which comprises electrically conductive carbon black dispersed in a thermoplastic synthetic polymer. The coloration of the conductive material may thereby be reduced by the sheath itself as well as by delustrants added to the polymeric material comprising the sheath. Despite the improvements obtained in a sheath/core structure, the coloration of a product employing carbon black as the conductive material is still such as to exhibit a reflectivity of less than 8 percent in the undelustered and heavily sheathed filament.

The dark coloration of the conductive filaments of the prior art necessitates the presence of at least one conductive filament in each yarn filament bundle in the visible yarns of most fabric constructions. In order to achieve antistatic effects, not every filament yarn bundle of a fabric need contain a conductive filament. However, if identical yarns are not employed, undesirable patterns are visable in the fabric when employing the dark colored conductive filaments of the prior art.

It is therefore an object of this invention to provide a conductive sheath/core filament having a resistance of less than $10^9$ ohms/inch at a potential of 2 kilovolts D.C. and an undelustered reflectivity greater than 8 percent.

It is a further object of this invention to provide a conductive sheath/core filament having a resistance of less than $10^9$ ohms/inch at a potential of 2 kilovolts D.C. and an undelustered reflectivity greater than 8 percent wherein the core comprises the major portion of the sheath/core cross section.

It is another object of this invention to provide a filament bundle of conductive and nonconductive filaments and fabric constructions employing said filament bundle wherein the conductive filament does not detract from the aesthetics of the nonconductive filaments.

It is still another object of this invention to provide a process for the preparation of a conductive sheath/core filament having a resistance of less than $10^9$ ohms/inch at a potential of 2 kilovolts D.C. and an undelustered reflectivity greater than 8 percent.

These and other objects of the invention will become more apparent from the following detailed description.

In accordance with this invention, it has now been discovered that a sheath/core conductive filament having a resistance of less than $10^9$ ohms/inch at a potential of 2 kilovolts and a reflectivity greater than 8 percent may be obtained by employing as the core a thermoplastic polymer having dispersed therein a material selected from the group consisting of zinc oxide, cuprous iodide, colloidal silver and colloidal graphite. The conductive filament of this invention employs as a sheath material a compatable fiber forming thermoplastic polymer. preferably, the sheath material is a polymer selected from the group consisting of polyamides, polyesters, and polyolefins. Preferably, the thermoplastic core material is a polyolefin such as polyethylene. The sheath material, which makes up a major percentage of the sheath/core cross sectional area, is most preferably a sheath material selected from the group consisting of nylon 6, nylon 66 and poly(ethylene terephthalate), and polypropylene.

The extrusion technique employed is a conventional sheath/core extrusion technique such as is set forth in U.S. Pat. Nos. 2,936,482 and 2,989,798, wherein a multicomponent filament is formed by jetting one or more core-forming components into radially converging flow of sheath-forming component and extruding the combination with the sheath-forming component surrounding the core-forming component.

The core component may be compounded by blending the conductive ingredient with a thermoplastic polymer having a lower melting point than the sheath polymer so as to permit drawing of the composite structure without destroying the continuity and hence the conductivity of the core. The conductive component of the core preferably has a particle size small enough to effect a thorough dispersion in the core polymer, the particle surface characteristics being irregular or porous so as to expose maximum surface area. Adequate dispersion of the conductive component in the host polymer is required in order to achieve maximum conductivity. The dispersing of the conductive material may be accomplished by mixing a blend of conductive material and molten polymer. For the textile application contemplated herein, the conductive filament may be provided in the form of continuous filaments, staple yarn, blended or plied yarns utilizing either continuous or staple length conductive filaments. The fiber is preferably of such diameter as to provide the desired simulation of conventional textile fiber characteristics, such as flexibility, crimpability, abrasion resistance, etc., range in size from 2 to 20 denier.

The following specific examples are given for purposes of illustration and should not be considered as limiting the spirit or scope of this invention.

EXAMPLE I

A core material for a sheath/core conductive filament is prepared by charging a mixer such as a Braybender plasticorder marketed by Braybender Instruments, Incorporated of South Hackensack, New Jersey, with 1000 grams of polyethylene having a melt index of 12. 430 grams of carbon black is then added, employing a mixing time of 15 minutes at a temperature of 190 degrees centigrade and a speed of 60 RPM. The graphite and polyethylene core material is then dried under vacuum for 24 hours at 70 degrees centigrade. Standard sheath/core spinning equipment is then employed to extrude circular cross-section sheath/core filaments, with the sheath material being polyethylene terephthalate having an intrinsic viscosity of 0.67. The sheath-/core filamentary material which is extruded under a nitrogen blanket is taken up at a speed of 1000 feet per minute (f.p.m.) so as to produce a filament bundle having a total denier of 210.

mined with a low voltage ohm meter. The filament bundle sample, usually about 3 filaments, 2 inches in length, is provided with silver paint electrodes at either extremity and a free filament bundle is clamped between the electrodes of the test equipment. The volume resistivity is then determined according to the formula, volume resistivity $=r(A/L)$ wherein r is the resistance in ohms, A is the cross-sectional area of the sample and L is the length of the sample bundle.

Values for density of the sheath/core fiber, conductivity of the dry powder conductive material, conductivity of the conductive material in polyethylne, reflectivity and static protection in carpet are given for each of the examples in the following table:

| Example No. | Conductive Core Material | Classification | Density in grams per c.c. | Conductivity Dry Powder | Conductivity of Compounded mat'l in PE | Reflectivity |
|---|---|---|---|---|---|---|
| I | Control Carbon Black | Semi-conductor | 1.0 | $10^{-1}$ohm-cm | 50 ohm-cm at 30% conc. | 7% |
| II | Graphite | Semi-conductor | 1.56 | $10^{-2}$ohm-cm | 70 ohm-cm at 40% | 11% |
| III | Cuprous Iodide | Conductivity dependent on $I_2$ conc. | 5.6 | Dependent on $I_2$ concentration | 200 ohm-cm at 80% | 31% |
| IV | Electrically Conductive Zinc oxide | Semi-conductor | 5.62 | 200 ohm-cm | 2000 ohm-cm at 83% | 57% |
| V | Colloidal Silver | Conductor | 10.0 | Below .01 ohm-cm | .01 ohm-cm at 65% | 24% |

EXAMPLE II

The process of Example 1 is repeated except that a 40% by weight dispersion of graphite in polyethylene having a melt index of 12 is employed as a core material.

EXAMPLE III

A 240 mililiter Braybender plasticorder is charged with 1000 grams of polyethylene having a melt index of 12 and sufficient cuprous iodide to result in a dispersion of 83% by weight cuprous iodide. The dispersion is mixed in the Braybender plasticorder for a mixing time of 15 minutes at a speed of 60 RPM and a temperature of 190 degrees centigrade. The core material is then extruded through standard sheath/core extrusion equipment employing, as the sheath material, polyethylene terephthalate having an intrinsic viscosity of 0.67. The product is extruded under a nitrogen blanket and taken up at a speed of 2100 f.p.m. so as to produce a product having a total denier of 200.

EXAMPLE IV

The process of Example III is repeated except that zinc oxide is substituted for cuprous iodide.

EXAMPLE V

The process of Example III is repeated except that colloidal silver is substituted for cuprous iodide.

The light reflectance which is a measure of whiteness of each of the examples is measured with a standard photoelectric reflection meter employing a barium sulfate ceramic tile as a reference. Monofilament samples are wound on a black mirror card using 8 to 10 layers of fiber. The mirror card is then inserted into a 3 centimeter slot opening in the photoelectric reflection meter. Ten measurements are then taken from each of the cards and an average value recorded.

To determine the resistance of each of the samples, the sheath is dissolved away and the resistivity deter- In order to evaluate visability and conductivity of conductive sheath/core filaments in textile applications, the following specific carpet structures are set forth:

EXAMPLE VI

A level loop carpet is prepared by tufting 1300 denier nylon yarn into a 10 ounce per square yard jute backing with a 5/32 gauge level loop machine wherein every eighth feed yarn contains one end of the conductive filament of Example I. The tufted product has a 5/32 inch pile height and a pile weight of 20 ounces per square yard. The tufted product is then dyed with the following dye bath:

0.33 grams per liter of Irgasol DA dispersing agent
0.08 grams per liter of aqueous ammonia, and
1% by weight, based on the weight of the fiber being dyed, of Irgalan Gray BL The gray dyed carpet is then oven dried at temperatures not in excess of 240° F.

The product is found to have an unacceptable appearance, the conductive ends in every eighth row being clearly visible giving the appearance of warp streaks.

EXAMPLE VII

The process of Example VI was repeated except that the conductive filament of Example II was employed. The dyed end product was found to be acceptable due to the reduced visibility of the conductive filaments providing an acceptable color merger with the dyed face yarns.

Each of the carpet samples were tested for static electricity control in an atmosphere control room having a temperature maintained at approximately 70 degrees Fahrenheit and a relative humidity of approximately 20 percent. The tests are conducted to simulate a person walking across the carpet and the electrostatic potential generated was measured. In all cases, static protection was found to be achieved.

Several theories have been advanced by various investigators on the source and nature of electrostatic phenomenon. One of the earliest and still supported by some investigators is that the phenomenon is capacitative in nature whereby the material serves as a storage medium for electrical charges induced or generated within the material by external stimuli. In this sense, the charge densities developed within the fibrous material would be related to the specific inductive capacity or dielectric constant of the material which in turn would relate to the mass specific resistance of the material and to the degree of electrical breakdown at the material-air interface.

What is claimed is:

1. A filament bundle selected from the group consisting of nylon or polyester filament bundles, containing at least one conductive filament having a resistance of less than $10^9$ ohms/inch at a potential of 2 kilovolts comprising a sheath/core conductive filament wherein the sheath/core structure, exclusive of delusterants has a reflectance of about 31 percent and wherein said core is a conductive core, comprising a thermoplastic polymer having dispersed therein cuprous iodide particulate material having a particle size not greater than three microns.

2. A filament bundle selected from the group consisting of nylon or polyester filament bundles, containing at least one conductive filament having a resistance of less than $10^9$ ohms/inch at a potential of 2 kilovolts comprising a sheath/core conductive filament wherein the sheath/core structure, exclusive of delusterants, has a reflectance of about 57 percent and wherein said sheath is a polyester sheath or a polyamide sheath and wherein said core is a conductive core, comprising a thermoplastic polymer having dispersed therein conductive zinc oxide particulate material having a particle size not greater than 3 microns.

* * * * *